US011309652B2

(12) United States Patent
Nakamura et al.

(10) Patent No.: US 11,309,652 B2
(45) Date of Patent: Apr. 19, 2022

(54) CONTACT FOR ELECTRICALLY CONNECTING A FIRST MEMBER AND A SECOND MEMBER USING SPRING PART

(71) Applicant: KITAGAWA INDUSTRIES CO., LTD., Inazawa (JP)

(72) Inventors: Tatsuya Nakamura, Kasugai (JP); Hiroyoshi Ishiguro, Kasugai (JP)

(73) Assignee: Kitagawa Industries Co., Ltd., Inazawa (JP)

( * ) Notice: Subject to any disclaimer, the term of this patent is extended or adjusted under 35 U.S.C. 154(b) by 0 days.

(21) Appl. No.: 16/962,333

(22) PCT Filed: Jan. 11, 2019

(86) PCT No.: PCT/JP2019/000746
§ 371 (c)(1),
(2) Date: Jul. 15, 2020

(87) PCT Pub. No.: WO2019/142745
PCT Pub. Date: Jul. 25, 2019

(65) Prior Publication Data

US 2020/0343666 A1 Oct. 29, 2020

(30) Foreign Application Priority Data

Jan. 16, 2018 (JP) ..... JP2018-004975

(51) Int. Cl.
*H01R 13/02* (2006.01)
*H01R 13/28* (2006.01)
(Continued)

(52) U.S. Cl.
CPC ..... *H01R 13/28* (2013.01); *H01R 13/2407* (2013.01); *H01R 13/5829* (2013.01)

(58) Field of Classification Search
CPC ..... H01R 13/28; H01R 13/26; H01R 13/20; H01R 13/193; H01R 13/10; H01R 13/02;
(Continued)

(56) References Cited

U.S. PATENT DOCUMENTS 6,626,708 B2 * 9/2003 Phillips ..... H01R 13/2428 439/700
6,814,626 B2 * 11/2004 Wen-Yao ..... H01R 13/7036 439/515
(Continued)

FOREIGN PATENT DOCUMENTS

CN 106716724 5/2017
EP 2863481 A1 4/2015
(Continued)

OTHER PUBLICATIONS

International Search Report from corresponding PCT Appln. No. PCT/JP2019/000746, dated Mar. 26, 2019.
(Continued)

*Primary Examiner* — Harshad C Patel
(74) *Attorney, Agent, or Firm* — Steven J. Grossman; Grossman, Tucker, Perreault & Pfleger PLLS

(57) ABSTRACT

The present invention provides a contact with low impedance even in a high frequency band. The contact (1) includes a base part (3), a contact part (5), and a spring part (7). The spring part (7) is elastically deformed to bias the contact part (5) in the x-axis positive direction and the z-axis positive direction. The contact part (5) includes a sliding part (23A) oriented in the x-axis positive direction. The base part (3) includes a part to be slided (14) oriented in the x-axis negative direction. The contact part (5) is biased in the x-axis positive direction by the spring part (7), so that the sliding part (23A) is in pressure contact with the part to be slided (14). The contact part (5) is configured to be slidable in the z-axis direction relative to the base part (3) while maintain-
(Continued)

ing a state in which the sliding part (23A) is in pressure contact with the part to be slided (14).

5 Claims, 6 Drawing Sheets

(51) Int. Cl.
*H01R 13/24* (2006.01)
*H01R 13/58* (2006.01)

(58) Field of Classification Search
CPC ..... H01R 13/24; H01R 13/22; H01R 13/187; H01R 13/18; H01R 13/17; H01R 13/11; H01R 13/2407; H01R 13/5829
USPC ..... 439/759
See application file for complete search history.

(56) References Cited

U.S. PATENT DOCUMENTS 6,872,881 B2 * 3/2005 Horng ..... H05K 9/0035 174/384
7,285,026 B1 * 10/2007 Ju ..... H01R 13/2421 439/700
7,300,288 B1 * 11/2007 Chen ..... H01R 13/2421 439/654
7,467,952 B2 * 12/2008 Hsiao ..... H01R 13/2421 439/66
7,559,769 B2 * 7/2009 Hsiao ..... H05K 7/1069 439/66
7,690,925 B2 * 4/2010 Goodman ..... H01R 13/2421 439/70
7,717,756 B1 * 5/2010 Yin ..... H01R 13/2421 439/700
7,841,864 B2 * 11/2010 Hsiao ..... H01R 13/2421 439/66
7,946,855 B2 * 5/2011 Osato ..... H01R 13/2421 439/66
8,052,428 B2 * 11/2011 Tsao ..... H01R 13/24 439/66
8,052,491 B2 * 11/2011 Lin ..... H01R 13/2421 439/786
8,066,536 B2 * 11/2011 Chen ..... H01R 13/2421 439/824
8,353,730 B1 * 1/2013 Wang ..... H01R 13/2421 439/700
9,379,466 B2 * 6/2016 Hashiguchi ..... H01R 13/2428
9,768,537 B2 * 9/2017 Kim ..... H01R 12/714
10,348,008 B2 * 7/2019 Nakamura ..... H01R 13/24
10,468,804 B2 * 11/2019 Kawamura ..... H01R 13/2421
10,511,114 B2 * 12/2019 Nakamura ..... H01R 12/71
10,777,928 B1 * 9/2020 Yen ..... H01R 13/2421
2006/0189177 A1 * 8/2006 Goodman ..... H01R 13/2421 439/70
2009/0023311 A1 * 1/2009 Goodman ..... H05K 7/1061 439/66
2010/0291810 A1 11/2010 Tsao
2015/0064984 A1 * 3/2015 Chiba ..... H01R 12/714 439/700
2016/0006183 A1 * 1/2016 Chiba ..... H01R 13/11 439/607.01
2016/0134045 A1 * 5/2016 Chen ..... H01R 12/716 439/700
2018/0241155 A1 * 8/2018 Suzuki ..... H01R 13/502

FOREIGN PATENT DOCUMENTS

JP 2003-036250 3/2003
JP 2003-69250 3/2003
JP 2003-69250 3/2010
JP 4482533 3/2010
WO 2016/047785 3/2016
WO 2016/194724 12/2016

OTHER PUBLICATIONS

Notice of Reason for Refusal from related Japanese Appln. No 2018-004975, dated May 7, 2021. English machine translation attached. Seven pages.
Office Action from related Chinese Appln. No. 201980007154.4, dated Jan. 26, 2021. English machine translation attached.
English translation of the International Preliminary Report on Patentability from corresponding PCT Appln. No. PCT/JP2019/000746, dated Jul. 30, 2020.
Extended European Search Report of European Application No. EP19741959.1 dated Sep. 10, 2021, 8 pages.
Office Action of Chinese Patent Application No. CN201980007154.4 with English translation, dated Jul. 28, 2021, 15 pages.

* cited by examiner

FIG.1A
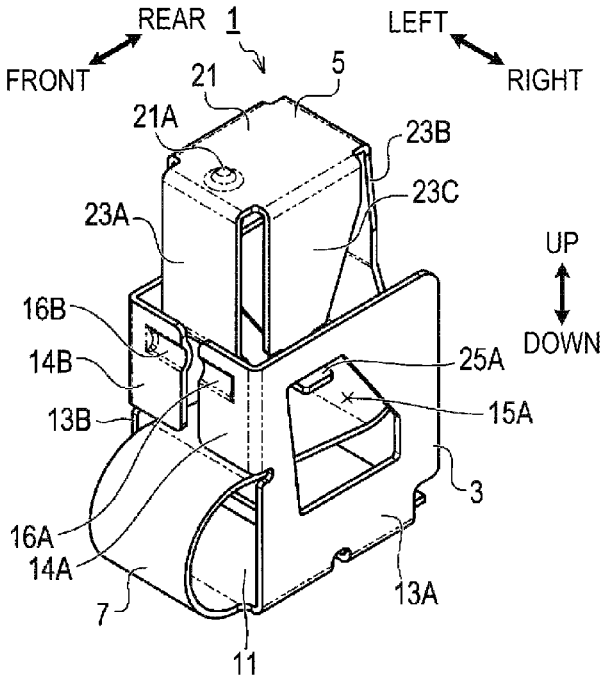
FIG.1B
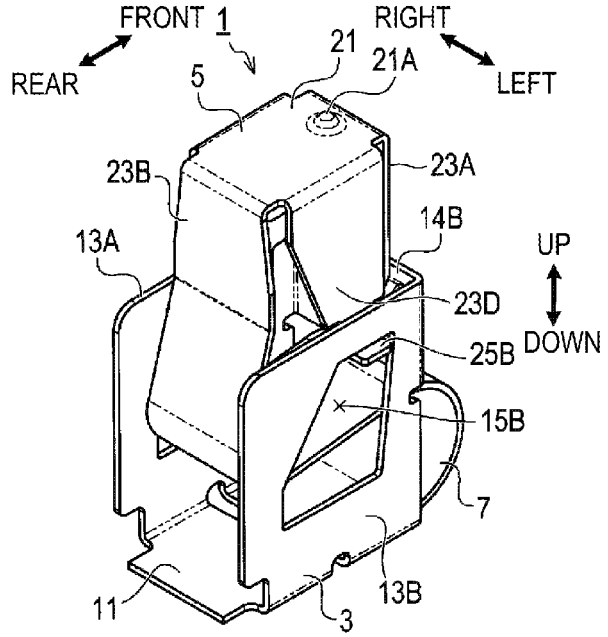
FIG. 1

FIG.2A
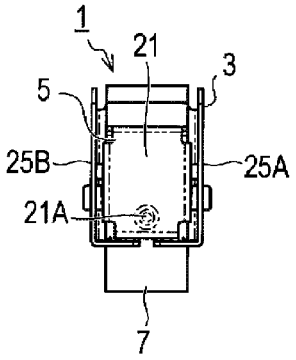
FIG.2B
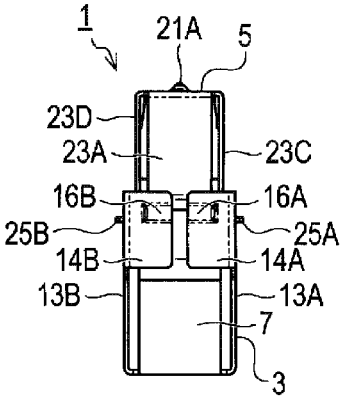
FIG.2C
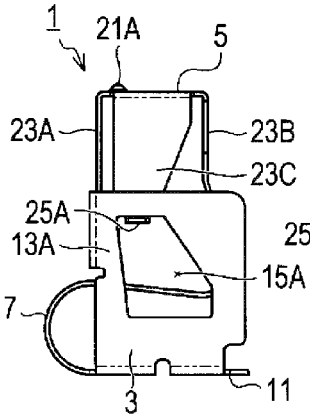
FIG.2D
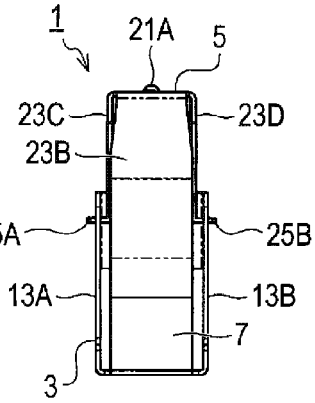
FIG.2E
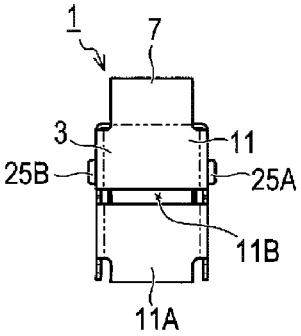
FIG. 2

FIG.4A
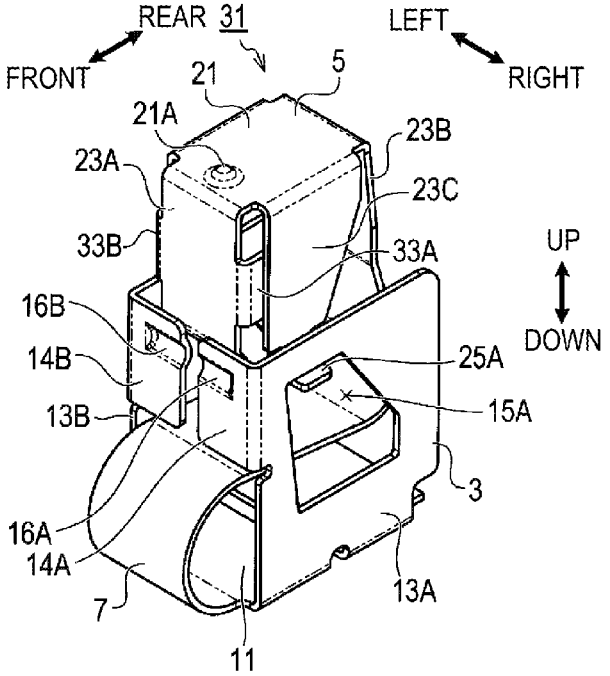
FIG.4B
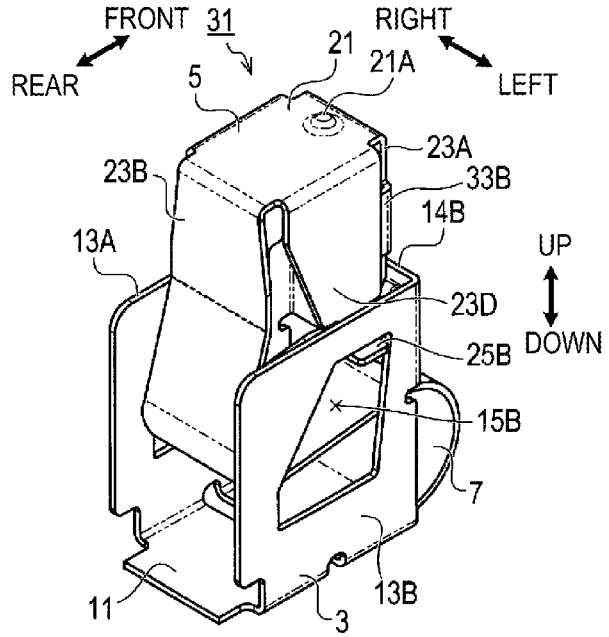
FIG. 4

FIG.5A
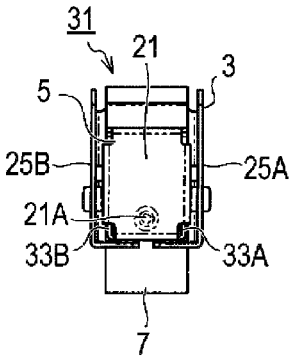
FIG.5B
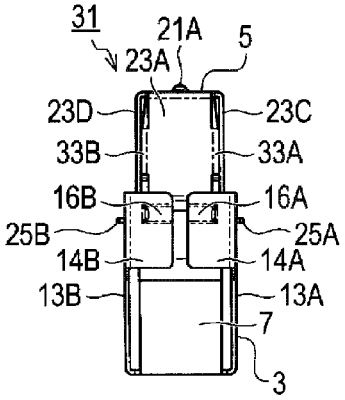
FIG.5C
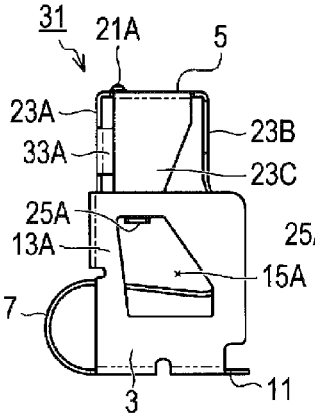
FIG.5D
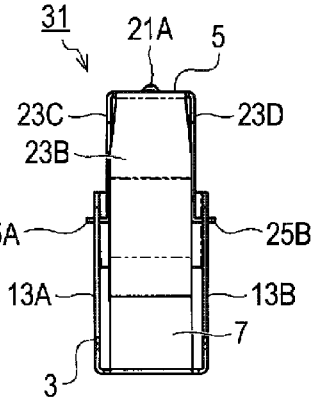
FIG.5E
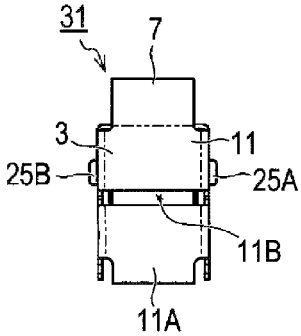
FIG. 5

FIG.6A
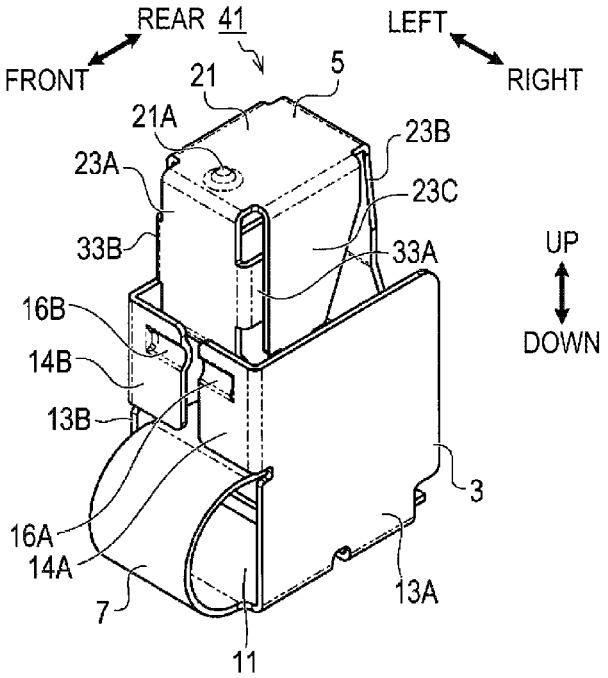
FIG.6B
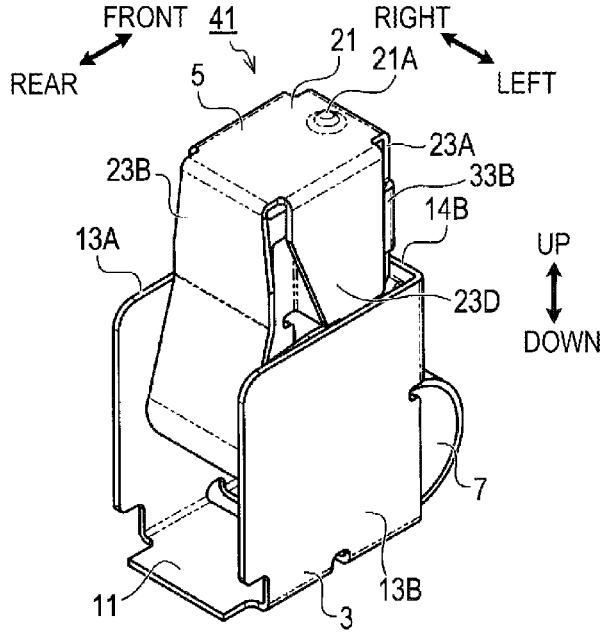
FIG. 6

CONTACT FOR ELECTRICALLY CONNECTING A FIRST MEMBER AND A SECOND MEMBER USING SPRING PART

TECHNICAL FIELD

The present disclosure relates to a contact.

BACKGROUND ART

As a component for grounding countermeasure, a contact capable of electrically connecting a first member and a second member is known (e.g., see Patent Document 1). Such a contact is soldered to, for example, a conductor pattern included in an electronic circuit board (corresponding to an example of a first member), and by coming into contact with the other conductive member other than the electronic circuit board (corresponding to an example of a second member, such as a housing of an electronic device), the contact electrically connects the conductor pattern with a conductive member.

CITATION LIST

Patent Literature

Patent Document 1: Japanese Patent No. JP 4482533 B

SUMMARY OF INVENTION

Technical Problem

In recent years, the frequency of electronic circuits has been increased, and there are increasing cases in which countermeasures are required on the higher frequency side. However, in the case of conventional contacts, many contacts exhibit high impedance in a high frequency band. Therefore, it is expected to develop a contact having a low impedance even in a high frequency band.

As a method of reducing the impedance of the contact, for example, a method of increasing the contact pressure between the second member and the contact can be considered. However, when the repulsive force of the spring part is increased simply to increase the contact pressure, a strong force continues to act on the first member or the second member. For this reason, for example, the electronic circuit board as the first member is likely to be bent, and when such bending is excessive, the electronic circuit board may be damaged.

In one aspect of the present disclosure, it is desirable to provide a contact having low impedance even in a high frequency band.

Solution to Problem

One aspect of the present disclosure is a contact capable of electrically connecting a first member and a second member. The contact includes a base part, a contact part, and a spring part. The base part includes a bonding surface that is soldered to the first member. The contact part is a part that is in contact with the second member. The spring part is provided between the base part and the contact part and is configured to be elastically deformable. In the present disclosure, a three dimensional orthogonal coordinate system is defined, in which an x-axis and a y-axis are parallel to a bonding surface, a z-axis is perpendicular to the bonding surface, and the bonding surface is oriented in a z-axis negative direction, and relative positions and movements of respective parts included in a contact is described.

The spring part is in a state of biasing the contact part in an x-axis positive direction and a z-axis positive direction by being elastically deformed. The contact part includes a sliding part that is oriented in the x-axis positive direction. The base part includes a part to be slided that is oriented in an x-axis negative direction. The contact part is biased in the x-axis positive direction by the spring part, so that the sliding part is in pressure contact with the part to be slided. The contact part is configured to be slidable in a z-axis direction relative to the base part while maintaining a state in which the sliding part is in pressure contact with the part to be slided.

According to the contact configured as described above, the contact part is biased in the x-axis positive direction by the spring part, and the sliding part is in a state of pressure contact with the part to be slided. In addition, the contact part slides in the z-axis direction relative to the base part while maintaining a state in which the sliding part is in pressure contact with the part to be slided. Therefore, at the sliding position between the base part and the contact part, a conductive path can be appropriately secured and impedance in a high frequency band can be reduced, as compared with the contact that does not include a configuration for maintaining a state of pressure contact.

BRIEF DESCRIPTION OF DRAWINGS

FIG. 1A is a perspective view of the contact according to the first embodiment as viewed from the upper right front side. FIG. 1B is a perspective view of the contact according to the first embodiment as viewed from the upper left rear side.

FIG. 2A is a plan view of the contact according to the first embodiment. FIG. 2B is a front view of the contact according to the first embodiment. FIG. 2C is a right side view of the contact according to the first embodiment. FIG. 2D is a rear view of the contact according to the first embodiment. FIG. 2E is a bottom view of the contact according to the first embodiment.

FIG. 4A is a perspective view of the contact according to the second embodiment as viewed from the upper right front side. FIG. 4B is a perspective view of the contact according to the second embodiment as viewed from the upper left rear side.

FIG. 5A is a plan view of the contact according to the second embodiment. FIG. 5B is a front view of the contact according to the second embodiment. FIG. 5C is a right side view of the contact according to the second embodiment. FIG. 5D is a rear view of the contact according to the second embodiment. FIG. 5E is a bottom view of the contact according to the second embodiment.

FIG. 6A is a perspective view of the contact according to the third embodiment as viewed from the upper right front side. FIG. 6B is a perspective view of the contact according to the third embodiment as viewed from the upper left rear side.

DESCRIPTION OF EMBODIMENTS

(1) First Embodiment

Figure 3:
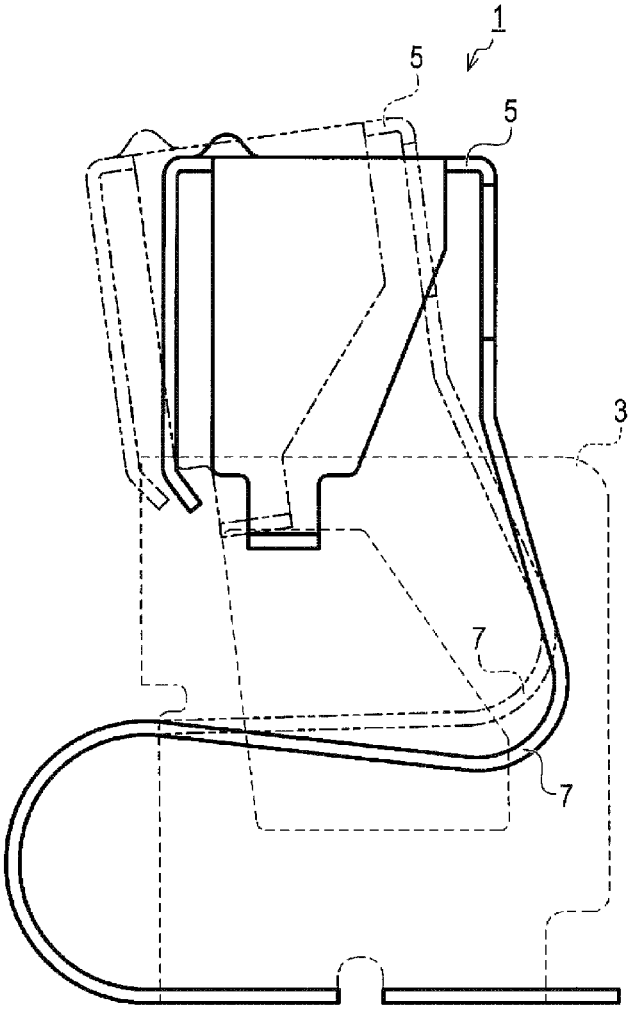
FIG. 3 is an explanatory view for explaining the shape of the spring part.

Next, the above-described contact is described with reference to exemplary embodiments. In the following description, it is defined herein that: a direction in which a position illustrated in the plan view of FIG. 2A faces is referred to "up" (corresponding to the z-axis positive direction in the present disclosure); a direction in which a position illustrated in the front view of FIG. 2B faces is referred to "front" (corresponding to the x-axis positive direction in the present disclosure); a direction in which a position illustrated in the right side view of FIG. 2C faces is referred to "right" (corresponding to the y-axis positive direction in the present disclosure); a direction opposite to the "right" is referred to "left" (corresponding to the y-axis negative direction in the present disclosure); a direction in which a position illustrated in the rear view of FIG. 2D faces "rear" (corresponding to the x-axis negative direction in the present disclosure); and a direction in which a position illustrated in the bottom view of FIG. 2E faces is referred to "down" (corresponding to the z-axis negative direction in the present disclosure).

In FIG. 1, the front, rear, left, right, up, and down directions are indicated by arrows. These directions are defined in order to describe the relative positional relationship among the components of a contact 1. Each of these directions does not define the direction in which the contact 1 is oriented when the contact 1 is used, for example. The left side view of the contact 1 is symmetrical to the right side view.

Contact Configuration

The contact 1 illustrated in FIGS. 1A, 1B, 2A, 2B, 2C, 2D, and 2E is a component capable of electrically connecting a first member and a second member. Examples of the first member include an electronic circuit board, for example. In this case, the contact 1 is soldered to a conductor pattern of the electronic circuit board. Examples of the second member include a conductive member different from the electronic circuit board. Examples thereof include a metal case, a metal panel, a metal frame, and various metal-plated components, which are included in electronic devices.

The contact 1 includes a base part 3, a contact part 5, a spring part 7, or the like. In the present embodiment, each of the base part 3, the contact part 5, and the spring part 7 is formed of a metal thin plate (in the present embodiment, a thin plate of beryllium copper for a spring plated with tin subjected to reflow treatment, thickness: 0.15 mm). The base part 3 is a part soldered to the first member. The contact part 5 is a part that is in contact with the second member. The contact part 5 is configured to be displaceable relative to the base part 3. The spring part 7 is a part provided between the base part 3 and the contact part 5. The spring part 7 is elastically deformed when the contact part 5 comes into contact with the second member and biases the contact part 5 toward the second member.

The base part 3 includes a bottom plate 11, a first side wall part 13A, a second side wall part 13B, a first front wall part 14A, and a second front wall part 14B. The lower surface of the bottom plate 11 serves as a bonding surface 11A to be soldered to the first member (see FIG. 2E). The bottom plate 11 is provided with a bottom surface opening 11B. The bonding surface 11A is divided into 2 regions on both sides across the bottom surface opening 11B. The first side wall part 13A extends upward from the right end portion of the bottom plate 11. The second side wall part 13B extends upward from the left end portion of the bottom plate 11.

The first front wall part 14A extends leftward from the front end of the first side wall part 13A. The second front wall part 14B extends rightward from the front end of the second side wall part 13B. The first side wall part 13A is provided with a first through hole 15A penetrating in the left-right direction. The second side wall part 13B is provided with a second through hole 15B penetrating in the left-right direction. The first front wall part 14A is provided with a first convex portion 16A. The second front wall part 14B is provided with a second convex portion 16B.

The contact part 5 includes a top plate 21, a first vertical part 23A, a second vertical part 23B, a third vertical part 23C, and a fourth vertical part 23D. The top plate 21 is provided with a protrusion 21A projecting upward. The protrusion 21A and a part of the upper surface of the top plate 21 serve as a contact point that is in contact with the second member. The first vertical part 23A extends downward from the front end portion of the top plate 21. The second vertical part 23B extends downward from the rear end portion of the top plate 21. The third vertical part 23C extends downward from the right end portion of the top plate 21. The fourth vertical part 23D extends downward from the left end portion of the top plate 21.

A first protrusion part 25A projecting rightward is provided at a lower end of the third vertical part 23C. The first protrusion part 25A enters the first through hole 15A of the first side wall part 13A. A second protrusion part 25B projecting leftward is provided at a lower end of the fourth vertical part 23D. The second protrusion part 25B enters the second through hole 15B of the second side wall part 13B.

When the contact part 5 is displaced in the vertical direction, the movable range of the first protrusion part 25A is restricted within the range of the first through hole 15A, and the movable range of the second protrusion part 25B is restricted within the range of the second through hole 15B. Thereby, the contact part 5 can be displaced up and down and back and forth within a predetermined range. The spring part 7 has a lower end connected to the front end portion of the bottom plate 11 and an upper end connected to the lower portion of the second vertical part 23B.

The spring part 7 biases the contact part 5 forward and upward. The contact part 5 is biased forward by the spring part 7, so that the front side of the first vertical part 23A is in pressure contact with the rear side of the first front wall part 14A and the second front wall part 14B. As indicated by a two-dot chain line in FIG. 3, the contact part 5 and the spring part 7 are at a position inclined forward from the reference position (see a solid line in FIG. 3), in a state where the restriction by the base part 3 (see a broken line in FIG. 3) is released.

When manufacturing the contact 1, the contact part 5 and the spring part 7 are displaced to the positions indicated by the solid lines in FIG. 3 while elastically deforming the spring part 7 as described above, and the contact part 5 and the spring part 7 are restricted inside the base part 3 in this state. Accordingly, the spring part 7 is restricted inside the base part 3 in an elastically deformed state, and the front side of the first vertical part 23A is brought into pressure contact with the rear side of the first front wall part 14A and the second front wall part 14B.

When the contact part 5 is displaced in the vertical direction, the front side of the first vertical part 23A slides while maintaining a state of pressure contact with the rear side of the first front wall part 14A and the second front wall part 14B. That is, the first vertical part 23A constitutes a sliding part in the present disclosure. In addition, the first front wall part 14A and the second front wall part 14B constitute a part to be slided in the present disclosure. In the following description, the first vertical part 23A is also referred to as a sliding part 23A. Both the first front wall part 14A and the second front wall part 14B are also collectively referred to as a part to be slided 14.

As illustrated in FIGS. 2A and 2D, a gap is provided between the contact part 5 (third vertical part 23C) and the first side wall part 13A in the left-right direction. A similar gap is also secured between the contact part 5 (fourth vertical part 23D) and the second side wall part 13B. Therefore, the contact part 5 is not in pressure contact with the first side wall part 13A or the second side wall part 13B.

According to the contact 1 configured as described above, the contact part 5 slides in the vertical direction relative to the base part 3 while maintaining the state in which the sliding part 23A is in pressure contact with the part to be slided 14. Therefore, at the sliding position between the base part 3 and the contact part 5, a conductive path can be appropriately secured and impedance in a high frequency band can be reduced, as compared with the contact 1 that does not include a configuration for maintaining a state of pressure contact.

Additionally, in the present embodiment, a gap is secured between the contact part 5 and the first side wall part 13A. Therefore, it is possible to suppress generation of sliding resistance between the contact part 5 and the first side wall part 13A. Furthermore, a gap is secured between the contact part 5 and the second side wall part 13B. Therefore, it is possible to suppress generation of sliding resistance between the contact part 5 and the second side wall part 13B. Therefore, the contact part 5 can be smoothly displaced in the vertical direction. Therefore, for example, even in a situation in which the distance between the first member and the second member varies due to vibration or the like, the contact part 5 can be smoothly displaced to a position following the second member, and the state in which the contact part 5 and the second member are electrically connected can be favorably maintained.

In addition, in the case of the present embodiment, the movable range of the contact part 5 can be restricted by using the first protrusion part 25A, the second protrusion part 25B, the first through hole 15A, and the second through hole 15B. Therefore, for example, the spring part 7 can be prevented from being stretched or crushed.

(2) Second Embodiment

Next, a second embodiment is described. In the second and subsequent embodiments, only a part of the configuration exemplified in the first embodiment is changed, and thus differences from the first embodiment is mainly described in detail. Additionally, configurations equivalent to those in the first embodiment are denoted by the same reference numerals as those in the first embodiment, and description thereof is omitted.

The contact 31 illustrated in FIGS. 4A, 4B, 5A, 5B, 5C, 5D, and 5E is a contact obtained by improving the contact 1 according to the first embodiment and further reducing the impedance.

Specifically, in the contact 31, the contact part 5 includes a first extending part 33A and a second extending part 33B. The first extending part 33A and the second extending part 33B are not provided in the contact 1 according to the first embodiment. The first extending part 33A extends rearward from a right end portion of the first vertical part 23A. The second extending part 33B extends rearward from the left end portion of the first vertical part 23A. The first extending part 33A is elastically deformed and is in pressure contact with the third vertical part 23C. The second extending part 33B is elastically deformed and is in pressure contact with the fourth vertical part 23D.

According to the contact 31 configured as described above, the first vertical part 23A and the third vertical part 23C are electrically connected to each other via the first extending part 33A. The second vertical part 23B and the third vertical part 23C are electrically connected to each other via the second extending part 33B. Therefore, the number of conductive paths from the top plate 21 to the first vertical part 23A is increased, and the impedance of the contact 1 can be reduced accordingly.

In order to confirm how much difference in performance occurs depending on the presence or absence of the first extending part 33A and the second extending part 33B, the following measurement was performed. The contact 31 was sandwiched between two stainless steel plates to compress the contact 31. A resin spacer was sandwiched between the two stainless steel plates together with the contact 31 so that the contact 31 was not compressed any more when the height of the contact 31 was compressed by 1 mm. The impedance between the two stainless steel plates was measured using a commercially available impedance analyzer.

As a result of the measurement, in the case of the contact 31 according to the second embodiment, the impedance at 100 MHz was an average value of 946 mΩ, a maximum value of 1000 mΩ, and a minimum value of 883 mΩ. The same measurement was performed on the contact 1 according to the first embodiment, and the average value was 1148 mΩ, the maximum value was 1223 mΩ, and the minimum value was 1071 mΩ. The difference between them was an average value of 202 mΩ, a maximum value of 223 mΩ, and a minimum value of 188 mΩ, and the contact 31 according to the second embodiment showed lower values in all cases.

(3) Third Embodiment

Next, a third embodiment is described. As illustrated in FIG. 6, the contact 41 of the third embodiment is obtained by omitting the first through hole 15A, the second through hole 15B, the first protrusion part 25A, and the second protrusion part 25B from the contact 31 according to the second embodiment. That is, in the contact according to the present disclosure, it is optional whether or not a configuration corresponding to the first through hole 15A, the second through hole 15B, the first protrusion part 25A, and the second protrusion part 25B is provided.

(4) Other Embodiments

Although the contact has been described with reference to the exemplary embodiments, the above-described embodiments are merely examples of one aspect of the present disclosure. That is, the present disclosure is not limited to the above-described exemplary embodiments and can be implemented in various forms without departing from the technical concept of the present disclosure.

For example, in the above-described embodiments, the base part 3, the contact part 5, and the spring part 7 are each integrally formed of a thin metal plate, but it is optional whether each of these parts is integrally formed.

It may be configured such that the functions realized by a single component in each of the above embodiments may be realized by a plurality of components. Further, it may be configured such that the functions realized by a plurality of components may be realized by a single component. A part of the configuration of each of the above embodiments may be omitted. In addition, at least a part of the configuration of each of the above-described embodiments may be added to or replaced for the configuration of the other above-described embodiments, or the like.

(5) Supplemental Descriptions

In addition, as is apparent from the exemplary embodiments described above, the contact of the present disclosure may further include the following configurations.

First, in one aspect of the present disclosure, the base part may include a first side wall part and a second side wall part that are spaced apart from each other in the y-axis direction. The contact part may be disposed at a position between the first side wall part and the second side wall part. A gap may be secured in the y-axis direction between the contact part and the first side wall part and between the contact part and the second side wall part.

According to the contact thus configured, a gap is secured between the contact part and the first side wall part. Therefore, generation of sliding resistance between the contact part and the first side wall part can be suppressed. Moreover, a gap is secured between the contact part and the second side wall part. Therefore, generation of sliding resistance between the contact part and the second side wall part can be suppressed. Therefore, the contact part can be smoothly displaced in the z-axis direction. Therefore, for example, even in a situation in which the distance between the first member and the second member varies due to vibration or the like, the contact part can be smoothly displaced to a position following the second member, and the state in which the contact part and the second member are electrically connected can be favorably maintained.

In one aspect of the present disclosure, the first side wall part and the second side wall part may be provided with a through hole penetrating in the y-axis direction. The contact part may be provided with a protrusion part projecting from the contact part in both the y-axis positive direction and the y-axis negative direction. The protrusion part may be inserted through the through hole, and a movable range of the protrusion part in the x-axis direction and the z-axis direction may be restricted by an inner periphery of the through hole.

According to the contact configured as described above, the movable range of the contact part can be restricted by using the protrusion part and the through hole. Therefore, for example, the spring part can be prevented from being stretched or crushed.

In one aspect of the present disclosure, the base part may include a bottom plate, a first side wall part, a second side wall part, a first front wall part, and a second front wall part. The bottom plate includes a bonding surface. The first side wall part extends in the z-axis positive direction from an end portion of the bottom plate in the y-axis positive direction. The second side wall part extends in the z-axis positive direction from an end portion of the bottom plate in the y-axis negative direction. The first front wall part extends in the y-axis negative direction from an end portion of the first side wall part in the x-axis positive direction. The second front wall part extends in the y-axis positive direction from an end portion of the second side wall part in the x-axis positive direction. The positions of the first front wall part and the second front wall part that are oriented in the x-axis negative direction constitute a part to be slided. The contact part may include a top plate, a first vertical part, a second vertical part, a third vertical part, and a fourth vertical part. The top plate is in contact with the second member at a position facing the z-axis positive direction. The first vertical part extends in the z-axis negative direction from an end portion of the top plate in the x-axis positive direction. The second vertical part extends in the z-axis negative direction from an end portion of the top plate in the x-axis negative direction. The third vertical part extends in the z-axis negative direction from an end portion of the top plate in the y-axis positive direction. The fourth vertical part extends in the z-axis negative direction from an end portion of the top plate in the y-axis negative direction. The sliding part is formed by a position of the first vertical part facing the x-axis positive direction. One end of the spring part is connected to an end portion of the bottom plate in the x-axis positive direction, the other end of the spring part is connected to an end portion of the second vertical part in the z-axis negative direction, and the spring part is configured to be elastically deformable between the one end and the other end.

In one aspect of the present disclosure, the first extending part and the second extending part may be provided. The first extending part extends in the x-axis negative direction from an end portion of the first vertical part in the y-axis positive direction. The second extending part extends in the x-axis negative direction from an end portion of the first vertical part in the y-axis negative direction. At least one of the first extending part and the third vertical part is elastically deformed and is in pressure contact with each other. At least one of the second extending part and the fourth vertical part is elastically deformed and is in pressure contact with each other.

According to the contact configured as described above, the first vertical part and the third vertical part are electrically connected to each other via the first extending part. The second vertical part and the third vertical part are electrically connected via the second extending part. Therefore, the number of conductive paths from the top plate to the first vertical part is increased, and the impedance of the contact can be reduced accordingly.

REFERENCE SIGNS LIST

1,31,41 Contact
3 Base part
5 Contact part
7 Spring part
11 Bottom plate
11A Bonding surface
11B Bottom surface opening
13A First side wall part
13B Second side wall part
14 Part to be slided
14A First front wall part
14B Second front wall part
15A First through hole
15B Second through hole
16A First convex portion
16B Second convex portion
21 Top plate
21A Protrusion
23A First vertical part
23A Sliding part
23B Second vertical part
23C Third vertical part
23D Fourth vertical part
25A First protrusion part
25B Second protrusion part
33A First extending part
33B Second extending part

What is claimed is:

1. A contact capable of electrically connecting a first member and a second member, comprising:

a base part with a bonding surface soldered to the first member;

a contact part that is in contact with the second member; and a spring part provided between the base part and the contact part and configured to be elastically deformable, wherein, when a three dimensional orthogonal coordinate system is defined, in which an x-axis and a y-axis are parallel to the bonding surface, a z-axis is perpendicular to the bonding surface, and the bonding surface is oriented in a z-axis negative direction, the spring part is in a state of biasing the contact part in an x-axis positive direction and a z-axis positive direction by being elastically deformed, the contact part includes a sliding part that is oriented in the x-axis positive direction, and the base part includes a part to be slided that is oriented in an x-axis negative direction, the contact part is in a state in which the sliding part is in pressure contact with the part to be slided by being biased in the x-axis positive direction by the spring part, the contact part is configured to be slidable in a z-axis direction relative to the base part while maintaining the state in which the sliding part is in pressure contact with the part to be slided, the base part includes a first side wall part and a second side wall part that are spaced apart from each other in a y-axis direction, the contact part is disposed at a position between the first side wall part and the second side wall part, a gap is secured in the y-axis direction between the contact part and the first side wall part and between the contact part and the second side wall part, the first side wall part and the second side wall part are provided with a through hole penetrating in the y-axis direction, the contact part is provided with a protrusion part that projects from the contact part in both a y-axis positive direction and a y-axis negative direction, and the protrusion part is inserted through the through hole, and a movable range of the protrusion part in an x-axis direction and the z-axis direction is restricted by an inner periphery of the through hole.

2. The contact according to claim 1, wherein the base part includes:

a bottom plate with the bonding surface;

the first side wall part extending in the z-axis positive direction from an end portion of the bottom plate in the y-axis positive direction;

the second side wall part extending in the z-axis positive direction from an end portion of the bottom plate in the y-axis negative direction;

a first front wall part extending in the y-axis negative direction from an end portion of the first side wall part in the x-axis positive direction; and a second front wall part extending in the y-axis positive direction from an end portion of the second side wall part in the x-axis positive direction, wherein a position in the first front wall part and a position in the second front wall part facing in the x-axis negative direction constitute the part to be slided, and the contact part includes:

a top plate that is in contact with the second member at a position facing the z-axis positive direction;

a first vertical part extending from an end portion of the top plate in the x-axis positive direction toward the z-axis negative direction;

a second vertical part extending from an end portion of the top plate in the x-axis negative direction toward the z-axis negative direction;

a third vertical part extending from an end portion of the top plate in the y-axis positive direction toward the z-axis negative direction; and a fourth vertical part extending from an end portion of the top plate in the y-axis negative direction toward the z-axis negative direction, wherein the sliding part is formed by a position of the first vertical part facing the x-axis positive direction, and one end of the spring part is connected to an end portion of the bottom plate in the x-axis positive direction, the other end of the spring part is connected to an end portion of the second vertical part in the z-axis negative direction, and the spring part is configured to be elastically deformable between the one end and the other end.

3. The contact according to claim 2, comprising:

a first extending part extending from an end of the first vertical part in the y-axis positive direction toward the x-axis negative direction;

a second extending part extending from an end portion of the first vertical part in the y-axis negative direction toward the x-axis negative direction, wherein at least one of the first extending part and the third vertical part is elastically deformed to be in pressure contact with each other, and at least one of the second extending part and the fourth vertical part is elastically deformed to be in pressure contact with each other.

4. A contact capable of electrically connecting a first member and a second member, comprising:

a base part with a bonding surface soldered to the first member;

a contact part that is in contact with the second member; and a spring part provided between the base part and the contact part and configured to be elastically deformable, wherein, when a three dimensional orthogonal coordinate system is defined, in which an x-axis and a y-axis are parallel to the bonding surface, a z-axis is perpendicular to the bonding surface, and the bonding surface is oriented in a z-axis negative direction, the spring part is in a state of biasing the contact part in an x-axis positive direction and a z-axis positive direction by being elastically deformed, the contact part includes a sliding part that is oriented in the x-axis positive direction, and the base part includes a part to be slided that is oriented in an x-axis negative direction, the contact part is in a state in which the sliding part is in pressure contact with the part to be slided by being biased in the x-axis positive direction by the spring part, the contact part is configured to be slidable in a z-axis direction relative to the base part while maintaining the state in which the sliding part is in pressure contact with the part to be slided, the base part includes a first side wall part and a second side wall part that are spaced apart from each other in a y-axis direction, the contact part is disposed at a position between the first side wall part and the second side wall part, a gap is secured in the y-axis direction between the contact part and the first side wall part and between the contact part and the second side wall part, the base part includes:

a bottom plate with the bonding surface;

the first side wall part extending in the z-axis positive direction from an end portion of the bottom plate in a y-axis positive direction;

the second side wall part extending in the z-axis positive direction from an end portion of the bottom plate in a y-axis negative direction;

a first front wall part extending in the y-axis negative direction from an end portion of the first side wall part in the x-axis positive direction; and a second front wall part extending in the y-axis positive direction from an end portion of the second side wall part in the x-axis positive direction, wherein a position in the first front wall part and a position in the second front wall part facing in the x-axis negative direction constitute the part to be slided, and the contact part includes:

a top plate that is in contact with the second member at a position facing the z-axis positive direction;

a first vertical part extending from an end portion of the top plate in the x-axis positive direction toward the z-axis negative direction;

a second vertical part extending from an end portion of the top plate in the x-axis negative direction toward the z-axis negative direction;

a third vertical part extending from an end portion of the top plate in the y-axis positive direction toward the z-axis negative direction; and a fourth vertical part extending from an end portion of the top plate in the y-axis negative direction toward the z-axis negative direction, wherein the sliding part is formed by a position of the first vertical part facing the x-axis positive direction, and one end of the spring part is connected to an end portion of the bottom plate in the x-axis positive direction, the other end of the spring part is connected to an end portion of the second vertical part in the z-axis negative direction, and the spring part is configured to be elastically deformable between the one end and the other end.

5. The contact according to claim 4, comprising:

a first extending part extending from an end of the first vertical part in a y-axis positive direction toward the x-axis negative direction;

a second extending part extending from an end portion of the first vertical part in a y-axis negative direction toward the x-axis negative direction, wherein at least one of the first extending part and the third vertical part is elastically deformed to be in pressure contact with each other, and at least one of the second extending part and the fourth vertical part is elastically deformed to be in pressure contact with each other.

* * * * *